US006095518A

United States Patent [19]

Allmendinger et al.

[11] Patent Number: 6,095,518

[45] Date of Patent: Aug. 1, 2000

[54] SHEET-DEPOSITING DEVICE

[75] Inventors: Franz Allmendinger, Aichwald; Christoph Münsch, Wiesensteig; Volker König, Ebersbach; Roland Wiest, Stuttgart, all of Germany

[73] Assignee: Eastman Kodak Company, Rochester, N.Y.

[21] Appl. No.: 09/084,746

[22] Filed: May 26, 1998

[30] Foreign Application Priority Data

May 28, 1997 [DE] Germany ..... 197 22 295

[51] Int. Cl.[7] ..... B65H 43/04

[52] U.S. Cl. ..... 271/215; 271/217; 271/220

[58] Field of Search ..... 271/207, 209, 271/213, 215, 217, 220, 176; 270/58.07, 58.08, 58.09, 58.12, 58.13, 58.17, 58.27, 58.28; 414/788.9, 790.2

[56] References Cited

U.S. PATENT DOCUMENTS

| | | | |
|---|---|---|---|
| 4,229,650 | 10/1980 | Takahashi et al. | 271/215 X |
| 4,390,175 | 6/1983 | Takahashi | 271/215 X |
| 5,407,188 | 4/1995 | Ida et al. | 217/215 |

FOREIGN PATENT DOCUMENTS 38 39 297 A1 5/1990 Germany .

*Primary Examiner*—David H. Bollinger
*Attorney, Agent, or Firm*—Clyde E. Bailey, Sr.

[57] ABSTRACT

Sheet stacks (4) removed from a collecting station (1) by a transport gripper (5) are deposited onto a vertically movable depositing table (6) so as to rest against stops (8, 10). The stops (8, 10), which are attached to stationary, horizontally movable pull-out rails (11), have first and second vertical surfaces (8*a* and 8*b*) which are interconnected by oblique surfaces (8*c*), the second surfaces (8*b*) being set back with respect to the first surfaces (8*a*). The upper surface of the deposited sheet stack (4) is kept at a functionally correct depositing level by two sensors (17, 18), of which one is associated with the center area and one with the staple area (12, 13). The deposited sheet stack (4) strikes against the first surfaces (8*a*) with its end face, and is then released by the transport gripper (5). Lowering the depositing table (6) causes the end face of the sheet stack (4) to enter the area of the set-back surfaces (8*b*), allowing it to rest without hindrance flat on the deposited stack (7). Raising the depositing table (6) causes the sheet stack (4) to be displaced laterally by the oblique surfaces (8*c*) of the stops (8, 10), and aligned flush with the deposited stack (7) by the first surface (8*a*).

5 Claims, 5 Drawing Sheets

SHEET-DEPOSITING DEVICE

FIELD OF THE INVENTION

The invention relates to a device for depositing sheets which, having been collected one on top of another in stapled or unstapled form in a collecting station, are removed from the collecting station by a gripper and deposited one on top of another onto a horizontally arranged depositing table of a depositing station, the sheets being stapled in the area which leads in the transport direction and, with this stapled area leading, being transported by the gripper to the depositing station until they are in contact at their ends against a stop of the depositing station; the vertically movable depositing table, controlled by a sensor which scans the upper surface of the deposited sheets, being held at a functionally correct depositing level.

BACKGROUND OF THE INVENTION

German Offenlegungsschrift 38 39 297 discloses a device which guides the copied sheets output from a copier into a collecting station and collects them there in sets. The complete sheet stack is stapled and transported by a transport gripper from the collecting station to a depositing station, in which the sheet stacks are deposited one on top of another. For this purpose, the transport gripper transports the sheet stack until its end comes into contact against a fixed stop of the depositing station, opens its gripping jaws, and moves back to a point behind the fixed stop. Because the sheet stack is already, before the sheet stack is released by the transport gripper, resting with the majority of its surface area on the deposited stack located underneath, the end area grasped by the transport gripper and bent up by it may not necessarily drop into a flat position after it is released, since that area is elevated on the fixed stop. This elevated area causes the height of the deposited stack to increase more quickly, and thus reduces the depositing capacity. With this known device, the depositing capacity is additionally reduced by the fact that as is known, the deposited stack grows more quickly in the thicker stapled area. Both effects also cause an unstable stack structure, so that a precisely positioned stack structure is not guaranteed.

SUMMARY OF THE INVENTION

It is the object of the invention to configure a device of the generic type in such a way that an increased depositing capacity and a stable and reliable stack structure are achieved. This is achieved, according to the invention, in that the stop is arranged in stationary fashion with respect to the vertical motion direction of the depositing table, and has a first vertical surface against which the sheet stack being deposited can be placed, and against which it can be aligned in precise position.

The stop has a second vertical surface which is arranged below the first surface and parallel thereto, and set back in such a way that it lies behind the first surface in the depositing transport direction. The two surfaces are interconnected by an oblique surface or a curved surface. The depositing table of the depositing device is movable vertically up and down relative to the stop; and the vertical position of the depositing table can be controlled, as a function of the position of the highest point of the upper surface of the deposited sheet stack as determined by at least one sensor, in such a way that the depositing table assumes a first position in which the most recently deposited sheet stack is associated with the first surface of the stop, and can be lowered into a second position in which the sheet stack is located opposite the second, set-back surface; and the depositing table can then be raised into its first position, thus by the oblique surface moving and laterally displacing the uppermost sheet stack toward the deposited stack located beneath, and aligning it against the first surface of the stop.

Advantageously, two stops of identical configuration are provided, which are attached to a horizontally movable pull-out rail and are in positive engagement with the depositing table, so that for the purpose of mutually offset depositing of the sheet stacks, the depositing table can be displaced horizontally in known fashion but the stops, which are also moved, cannot have a negative influence on the ordered stack structure.

In a further advantageous embodiment of the invention, the depositing table is equipped, in the area of its depositing surface associated with the stapled area of the sheet stack, with recesses or depressions to accommodate the thicker stapled area. The embodiment and mode of operation of the stops according to the invention and the configuration of the depositing surface of the depositing table result in a greater depositing capacity and a stable and orderly stack structure.

BRIEF DESCRIPTION OF THE DRAWINGS

Further features and advantages are evident from the description of an embodiment of the invention depicted in the drawings, and from the dependent claims. In the schematic drawings

DETAILED DESCRIPTION OF THE INVENTION

Figure 1:
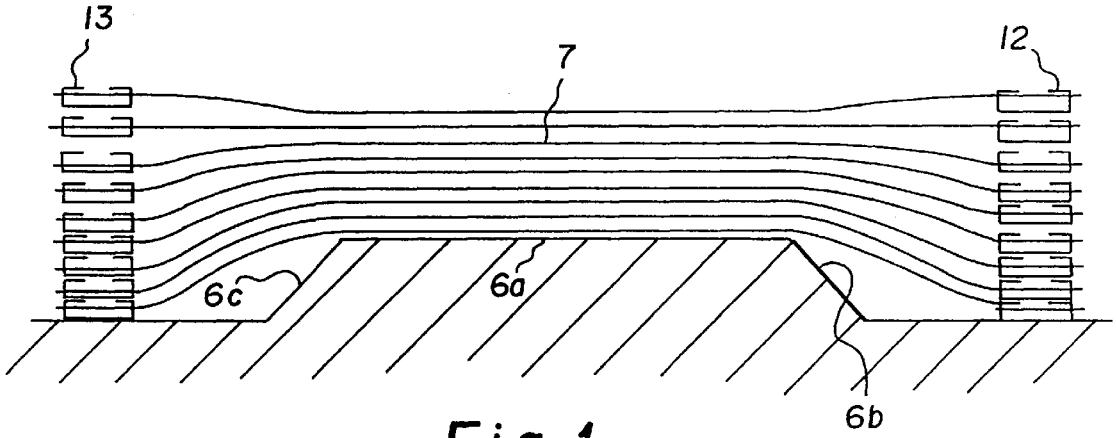
FIG. 1 shows a partial front view of the sheet depositing device, according to this invention in section.

It is the object of the sheet depositing device according to the invention to collect copied sheets, output from a copier (not depicted) of known type, into sets, staple the collected sheet stack as ordered or leave it unstapled, and transport the complete sheet stack into a depositing station.

For this purpose, the sheet depositing device according to the invention has a collecting station 1 into which the sheets output by the copier are fed in the direction of the arrow "A". In collecting station 1, which is arranged to point obliquely downward at an acute angle of approximately 40 degrees with respect to sheet transport direction "A", the fed-in sheets slide until coming to rest against a lower delimiter 3, where their edges are aligned in known fashion, by an orienting mechanism (not depicted) of known type, against both lower delimiter 3 and a lateral delimiter (not depicted) to form a sheet stack 4. Lower delimiter 3 can be moved in known fashion (not depicted) out of the transport path of the completed sheet stack 4.

Associated with collecting station 1 in the area of lower delimiter 3 are stapling devices (not depicted) of known type, which laterally overlap collecting station 1 in such a way that after stapling, a sheet stack can be transported through the stapling devices. A depositing station 2, which has a depositing table 6 vertically movable in known fashion, is arranged below collecting station 1 and downstream therefrom in transport direction "A".

Figure 2:
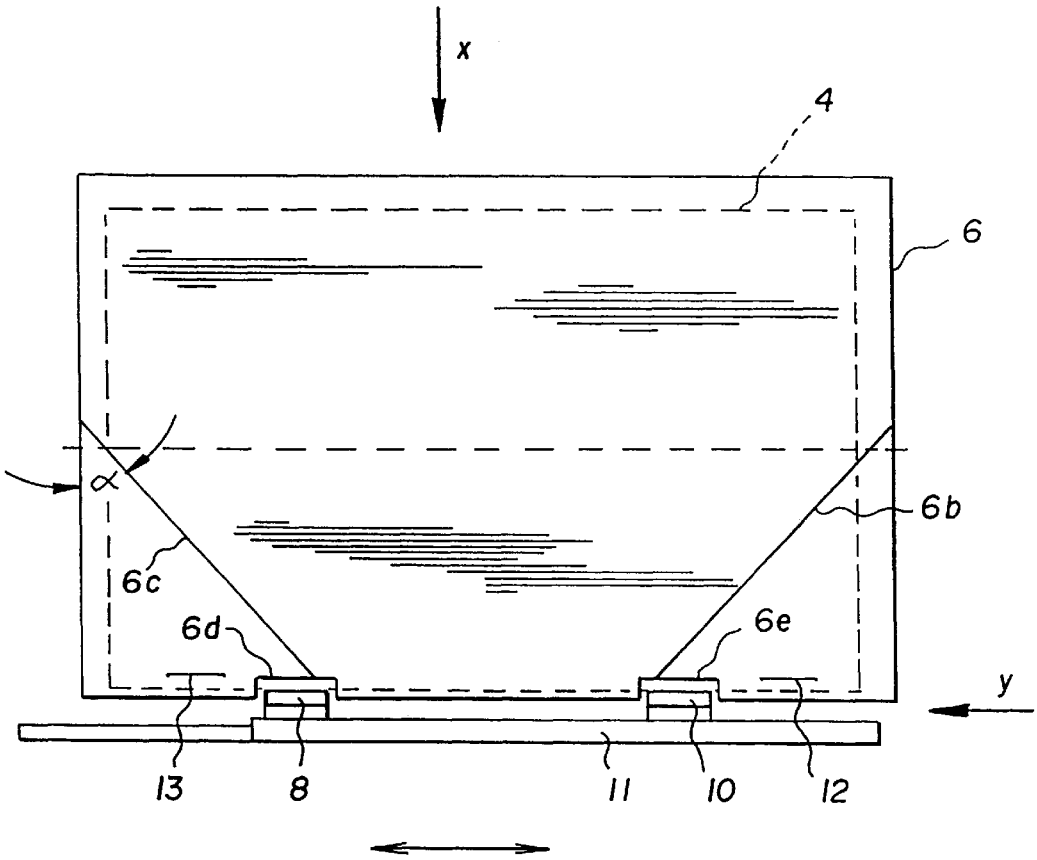
FIG. 2 shows a plan view of the sheet depositing device.

Two stops 8 and 10, which delimit the depositing area in gripper transport direction "D", are associated with depositing table 6. As FIG. 2 shows, stops 8 and 10 are arranged on a horizontally displaceable pull-out rail 11 of known type which is attached in stationary fashion. Stops 8 and 10 engage positively into recesses 6*d* and 6*e*, respectively, of depositing table 6, thus making possible a vertical motion of depositing table 6 along stops 8 and 10 which are stationary in this motion direction. When depositing table 6 moves horizontally for mutually offset depositing of sheet stacks 4, stops 8 and 10 are also moved in the horizontal direction because of their positive connection to depositing table 6, so that no disruptive relative motions occur between the sheets and stops 8 and 10, thus eliminating the risk of lateral twisting or slipping.

Stops 8 and 10 are each equipped with first and second vertical surfaces 8*a* and 8*b*, visible in the FIGS., which are interconnected by means of an oblique surface 8*c*. Second surface 8*b* is set back approximately 2 to 3 mm with respect to the first surface, second surface 8*b* being located behind first surface 8*a* when viewed in gripper transport direction "D". Oblique surface 8*c* has an angle of approximately 10 degrees.

Depositing surface 6*a* of depositing table 6 is equipped, in the manner depicted in FIGS. 1 and 2, with recesses 6*b* and 6*c* which are associated with the thicker stapled area 12 and 13 of sheet stacks 4 and which are arranged and configured in such a way that they allow that sheet stack area to bend into and thus be accommodated in recesses 6*b* and 6*c*. Recesses 6*b* and 6*c* preferably form a cutout angle $\alpha$ of approximately 45 degrees.

Stack transport between collecting station 1 and depositing table 6 is accomplished by a transport gripper 5 not depicted in further detail. The transport gripper, indicated only schematically, can, for example, be configured in accordance with the transport gripper disclosed by German Offenlegungsschrift 38 39 297. Transport gripper 5 is movable in the directions of the arrows "D" and "E", and assumes essentially three functional positions: a first ("F") is associated with grasping of a completed sheet stack 4, a second ("G") with the end of the transport motion, and a third ("H") with the release of sheet stack 4.

Figure 7:
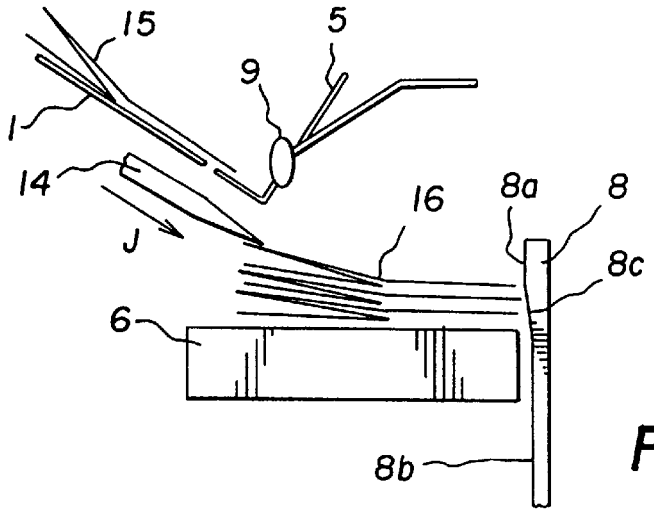
FIGS. 7 to 9 show the sheet depositing device as depicted in FIGS. 3 to 5, with an additional guide element.
Figure 8:
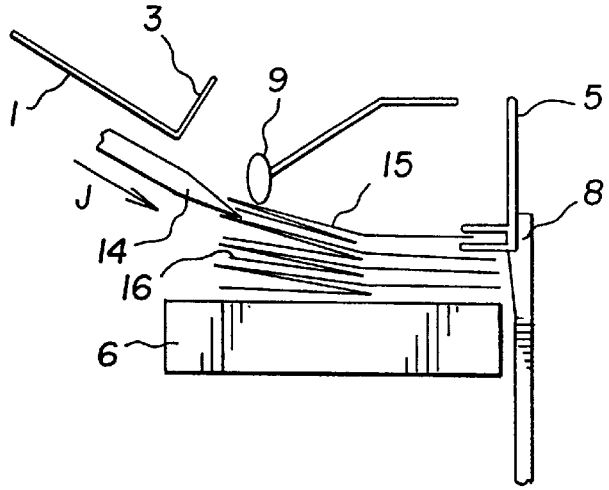
Figure 9:
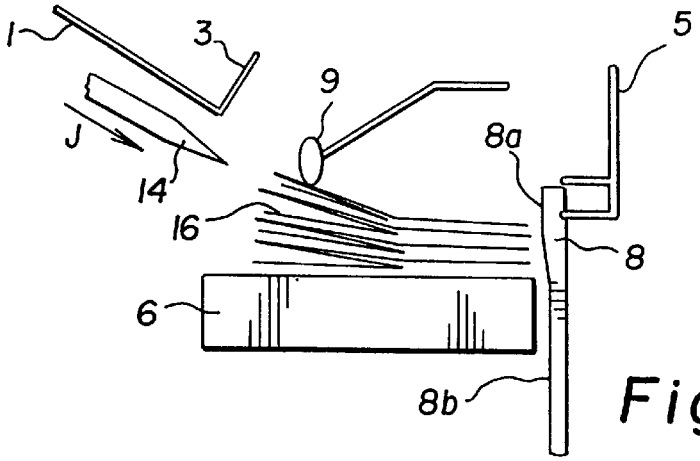
Figure 10:
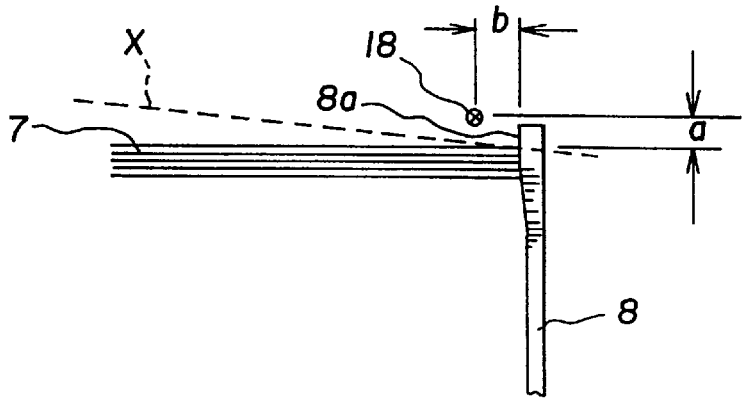
FIG. 10 shows the sheet depositing device as depicted in FIG. 2 in a side view.
Figure 11:
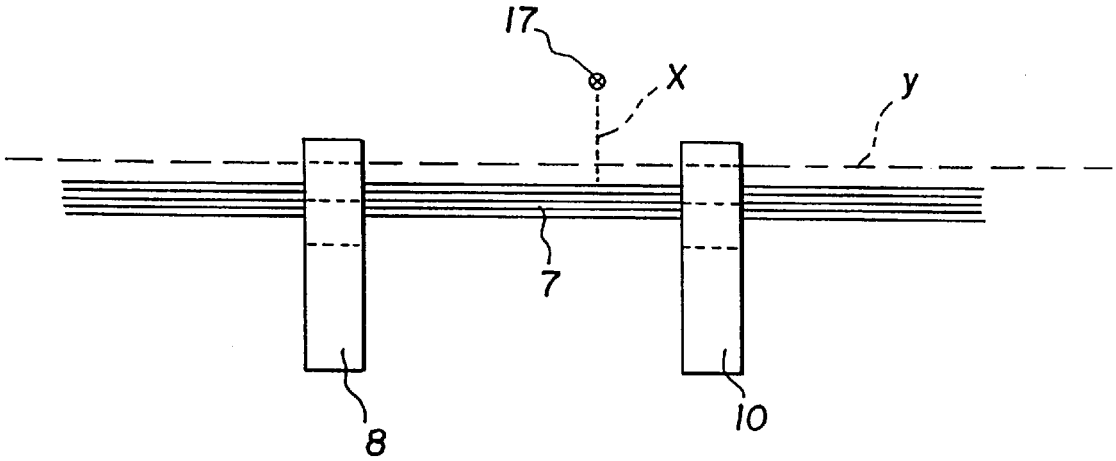
FIG. 11 shows the sheet depositing device as depicted in FIG. 2 in a front view.

A holddown 9 of known type which can be placed onto the upper surface of the sheet stack is arranged above depositing table 6. Located below collecting station 1 is a guide element 14, movable in the direction of the arrrow "I", which can be transferred from a position as shown in FIG. 9 above the depositing area into a position as shown in FIG. 7 projecting above a deposited stack 16 and, in particular, guarantees unhindered depositing of Z-folded sheets. The upper surface of sheet stack 4 deposited onto deposited stack 7 is kept at a functionally correct depositing level in a known manner, by means of a control device not depicted; sensors of known type scan the upper surface of the stack and adjust depositing table 6 in its vertical motion direction accordingly. The device according to the invention has, however, both a particular arrangement of the sensors and a special control system for depositing table 6. For this, a first sensor 17 is provided, whose scanning beam "X" extends approximately in transport direction "A" and is associated with the center area, associated with stops 8 and 10, of the upper surface of the stack. A second sensor 18, whose scanning beam "Y" extends parallel to stop surfaces 8*a*, is positioned at a distance a of approximately 5 mm above the depositing level of deposited stack 7 determined by first sensor 17, and is arranged at a distance b of approximately 20 mm in front of stop surfaces 8*a*.

While first sensor 17 essentially determines the depositing level for unstapled sheet stacks 4, second sensor 18 is associated with the staple area of stapled sheet stacks 4, and causes a lowering of depositing table 6 to a functionally correct depositing level if the staple area is elevated by more than 5 mm. The level control system is designed so that despite the presence of elevated staple areas in deposited stack 7, sheet stack 4 that is to be deposited next can be moved unhindered onto deposited stack 7, and does not need to fall too far when released.

Figure 3:
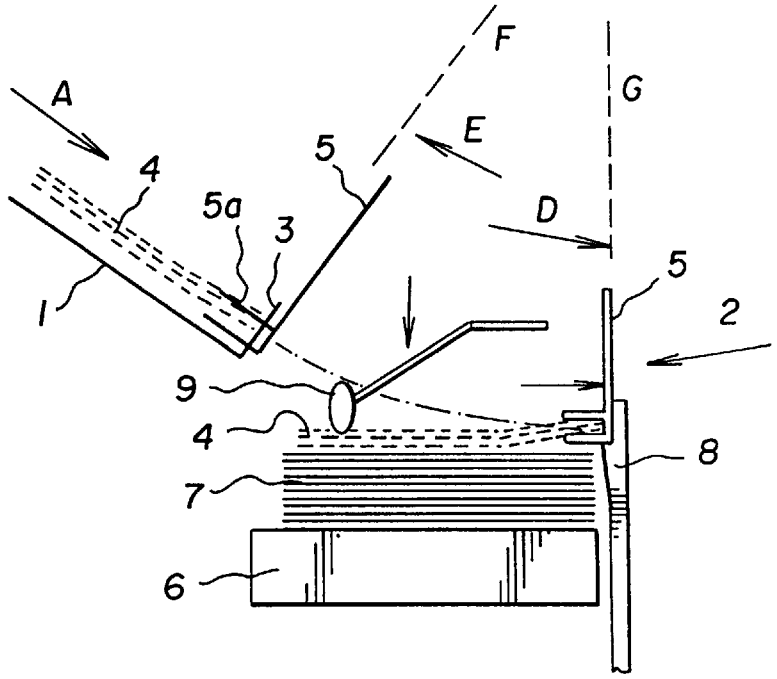
FIG. 3 shows a side view of the device at the time the sheet stack is being deposited.

The sheet depositing device according to this invention operates in the following manner: As shown in FIG. 3, the sheet depositing device assumes an initial position in which the copied sheets being fed into collecting station 1 are collected into a sheet stack 4, front delimiter 3 being closed and transport gripper 5 overlapping the collecting area with its gripper jaws 5*a* open. Once the intended number of sheets has been collected, sheet stack 4 is stapled if applicable. The completed sheet stack 4, stapled or unstapled, is then grasped by transport gripper 5 by closing gripper jaws 5*a*, and transported in the direction of the arrow "D". During this transport phase, holddown 9 is located above the transport path of sheet stack 4. At the end of the transport motion, sheet stack 4 is released by transport gripper 5, by opening gripper jaws 5*a*, in position "G", in which it rests with its end face against the first vertical surfaces 8*a* of stops 8 and 10. The opened transport gripper 8 is then moved into a position "H" located behind surfaces 8*a*, 8*b* of stops 8 and 10.

Figure 4:
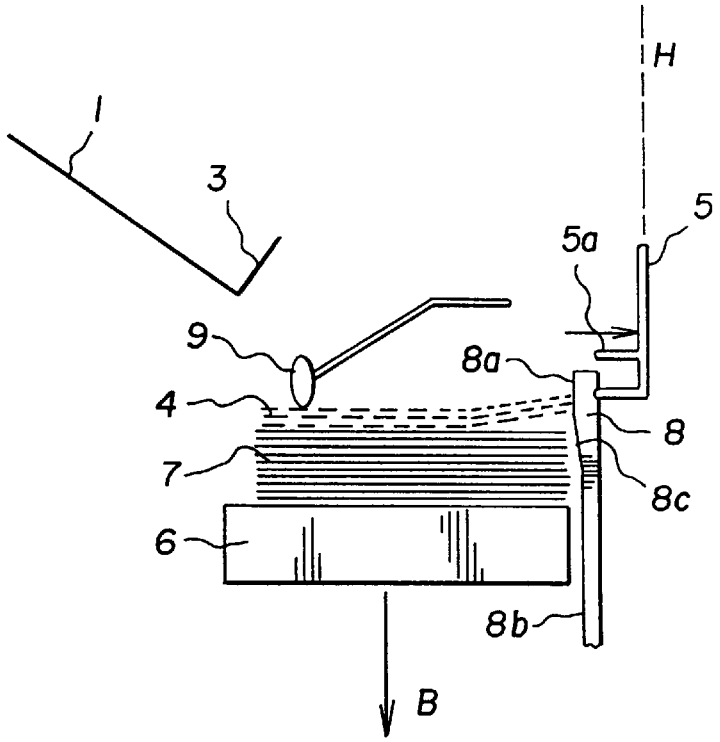
FIG. 4 shows the sheet depositing device as depicted in FIG. 3 at the time the sheet stack is being released.

As soon as the trailing end of sheet stack 4, transported in the direction of the arrow "D" by transport gripper 5, has left collecting station 1, sheet stack 4 falls down onto deposited stack 7 below, so that much of its surface is already resting on deposited stack 7 even before its end area has been released from the grasp of transport gripper 5. At the end of the transport motion, holddown 9 is placed onto sheet stack 4 and holds the latter in position, so that it cannot slip when transport gripper 5 opens. At this point in time the not-yet-released end area of deposited sheet stack 4 assumes a slightly upwardly curved position which, in the case of stapled sheet stacks 4, it may possibly retain even when transport gripper 5 is opened and moved into position "H", as depicted in FIG. 4. This upwardly curved position of the deposited sheet stack 4 does not change, in particular, if the adhesive friction of the larger contact area is greater than the weight exerted by the smaller, elevated end area of sheet stack 4. If this unfavorable deposited state were not changed, the result would be a disordered and unstable stack structure.

Figure 5:
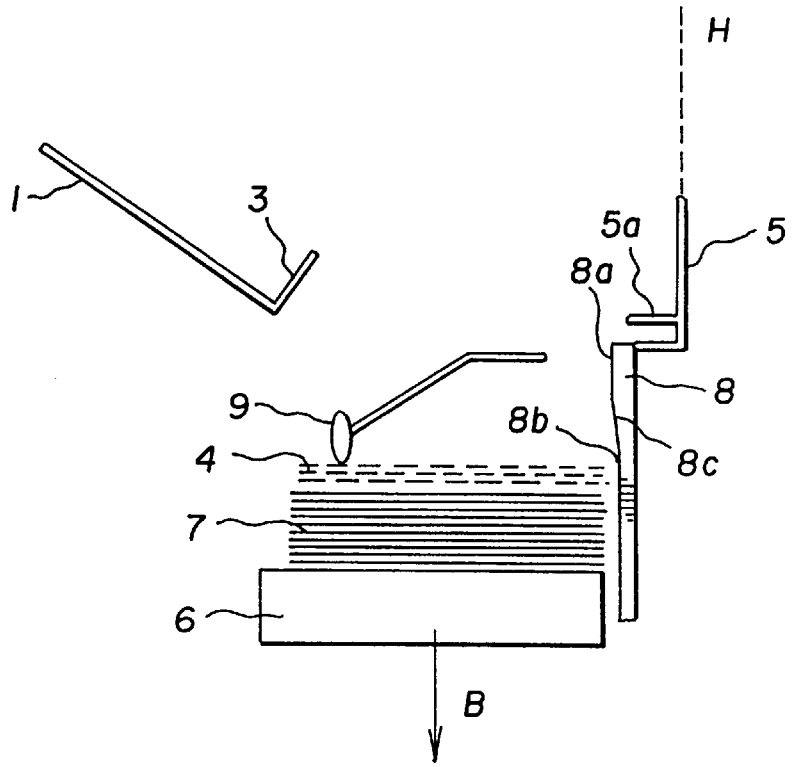
FIG. 5 shows the sheet depositing device as depicted in FIG. 4 with the depositing table lowered.

Therefore, once transport gripper 5 has reached position "H", depositing table 6 is lowered approximately 20 mm in the direction of the arrow "B" as shown in FIG. 5. The end area of sheet stack 4 thus moves away from its contact against first surfaces 8*a* of stops 8 and 10 until it is then positioned opposite second surfaces 8*b* thereof. Holddown 9, after having briefly rested again on the upper surface as depositing table 6 is lowered, is then moved back into its upper initial position as shown in FIG. 7. Since second surfaces 8*b* are set back, as already described, the end area of sheet stack 4 is released by this motion of depositing table 6, so that it can drop under its own weight until it is resting in planar fashion on deposited stack 7 below, and thus forms a stable base for the next sheet stack to be deposited. Depositing quality is also enhanced by recesses 6*b* and 6*c*, already described, in depositing table 6, into which stapled areas 12, 13 of sheet stack can descend, so that because the staple structure then projects upward to a lesser extent, a greater depositing capacity and stable stack structure can be achieved, as shown in FIG. 1.

Figure 6:
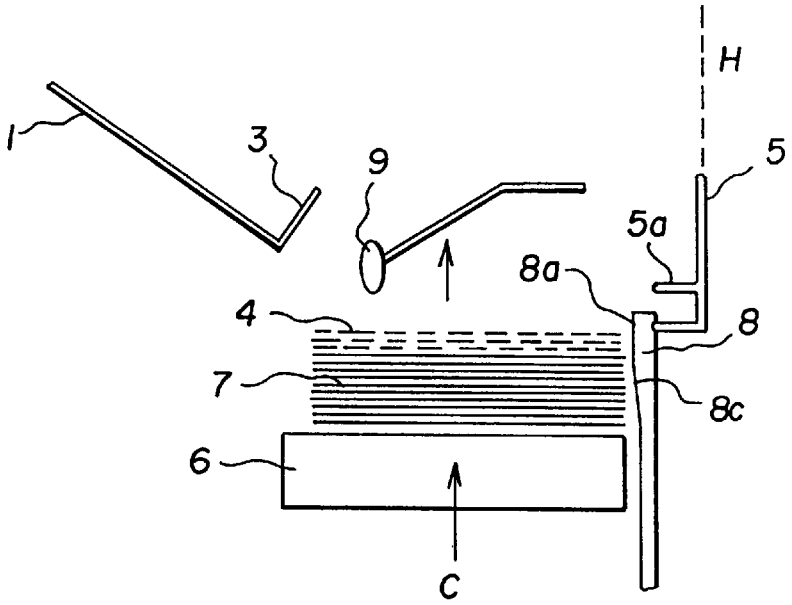
FIG. 6 shows the sheet depositing device as depicted in FIG. 5 with the depositing table raised.

Once the deposited sheet stack 4 is resting flat on deposited stack 7, depositing table 6 is raised in arrow direction "C" until the uppermost sheet stack 4 is once again located opposite first surfaces 8*a* of stops 8 and 10. This position is controlled by the scanning of the sheet stack surface performed by sensors 17 and 18. During this upward motion of depositing table 6, sheet stack 4, whose end area projects beyond deposited stack 7, is pushed back by the oblique surfaces 8*c* of stops 8 and 10 until sheet stack 4, as shown in FIG. 6, is aligned flush with the end faces of deposited stack 7 below, resting against first surfaces 8*a*.

During this upward motion of depositing table 6 in the direction of the arrow "C", oblique surfaces 8*c* of stops 8 and 10 exert a force on the uppermost sheet stack 4 which acts toward deposited stack 7, so that the air cushion located between the sheets is diminished, thereby again increasing the depositing capacity. After this alignment operation, the upper surface of the sheet stack once again assumes an initial position in which a next sheet stack 4 can, as already described, be deposited unhindered.

If Z-folded sheets 15 are to be deposited with the device described above, holddown 9 is first lowered onto deposited stack 16, thereby pressing the resilient area of deposited stack 16 until it is below the movement path of guide element 14. Guide element 14 is then moved in the direction of the arrow "I" from the position shown in FIG. 9 outside the depositing area to a location above the Z-folded area of deposited stack 16 (see FIG. 7), and holddown 9 is lowered again. A Z-folded sheet 15 transported by transport gripper 5 in the manner already described can then be deposited unhindered onto deposited stack 16.

Holddown 9 is then placed onto the deposited sheet, guide element 14 is pulled back opposite to the direction of the arrow "I", and the entire deposited stack 16 is then pushed down below the movement path of guide element 14. The other functions of the sheet depositing device with regard to sheet alignment and regulation of the depositing level are performed in the same way as described above.

The invention has been described in detail with particular reference to certain preferred embodiments thereof, but it will be understood that variations and modifications can be effected within the spirit and scope of the invention.

What is claimed is:

1. Device for depositing sheets, said sheets having been collected one on top of another in either a stapled or unstapled form in a collecting station, said either a stapled or unstapled form being removable from the collecting station by a gripper and then deposited one on top of another onto a horizontally arranged depositing table of a depositing station, said depositing table being arranged for vertical movements, said sheets comprising the stapled form being stapled in an lead end area of said sheets defining a depositing transport direction of said sheets, said sheets being transported in the depositing transport direction by the gripper to the depositing station until nearest adjacent sheets are in contact and corresponding lead end areas of said nearest adjacent sheets are at rest exposing an upper surface of deposited sheets, said deposited sheets forming a sheet stack; the vertical movements of said depositing table being controlled by a sensor which scans the upper surface of the deposited sheets and held at a functionally correct depositing level, said device for depositing sheets comprising:

a first stop and second stop fixedly arranged in said depositing station relative to vertical movement of said depositing table, said first stop and second stop each having a first vertical surface against which the sheet stack being deposited can be placed, and against which said sheet stack can be aligned in precise position; and, said first stop and second stop each having a second vertical surface which is arranged below said first vertical surface and parallel thereto, and set back in such a way that said second vertical surface lies behind said first vertical surface in the depositing transport direction (d); said first and second vertical surfaces being interconnected by an oblique surface or a curved surface; said depositing table being movable vertically up and down relative to said first stop and second stop; and wherein movements of said depositing table to a vertical position being controlled, as a function of stack height determined by at least one sensor, such that said depositing table assumes a first position in which most recently deposited sheet stack is associated with said first vertical surface of said first stop; and wherein said depositing table can be lowered into a second position in which said sheet stack is located opposite said second vertical surface of first stop and second stop; and, wherein said depositing table can then be raised into said first position by said oblique surface moving and laterally displacing said most recently deposited sheet stack toward the deposited stack located therebeneath, and aligning said sheet stack against said first vertical surface of said first stop and second stop.

2. The sheet depositing device as defined in claim 1, further comprising first and second sensors operably associated with said upper surface of said stacked sheets for determining the vertical position of the sheet stack upper surface are associated with the upper surface of the sheet stack (4) being deposited; said sensor having a scanning beam that extends substantially parallel to said first stop and scans the stapled area on the upper surface of the sheet stack adjacent to said stop; and the direction of action (X) of the other of said sensors extends approximately perpendicular to the end-face stop edge of the sheet stack and scans approximately the center of the width of the upper surface of the sheet stack.

3. The sheet depositing device as defined in claim 2, wherein said first and second stops are guided in horizontally movable fashion on a pull-out rail; and said first and second stops being arranged for positive engagement into a recess of said depositing table.

4. The sheet depositing device as defined in one of claim 3, wherein said depositing table comprises at least one recess proximate to the top surface of said depositing table for accommodating a thicker stapled area of said sheet stack.

5. The sheet depositing device as defined in claim 4, further comprising identically configured stops arranged for engaging positively into recesses of said depositing table.

* * * * *